US005765909A

United States Patent [19]

Catrinar

[11] Patent Number: 5,765,909

[45] Date of Patent: Jun. 16, 1998

[54] CHAIR WITH SELF STORABLE TRAY

[76] Inventor: Thomas J. Catrinar, 7000 Ten Mile, Apt. 610, Center Line, Mich. 48015

[21] Appl. No.: 927,764

[22] Filed: Sep. 11, 1997

[51] Int. Cl.[6] ..... A47B 39/00

[52] U.S. Cl. ..... 297/146; 297/154; 297/173

[58] Field of Search ..... 297/146, 150, 297/154, 162, 173, 174

[56] References Cited

U.S. PATENT DOCUMENTS

| | | | |
|---|---|---|---|
| Re. 7,582 | 3/1877 | Stevens . | |
| 202,788 | 4/1878 | Camlier . | |
| 859,557 | 7/1907 | Hencke . | |
| 1,387,049 | 8/1921 | Gunderson . | |
| 2,084,448 | 6/1937 | Merchant . | |
| 3,213,467 | 10/1965 | Hubbard . | |
| 3,369,839 | 2/1968 | Telarico . | |
| 3,675,968 | 7/1972 | Douglas | 297/154 X |
| 4,932,718 | 6/1990 | Yamaraki | 297/146 |

FOREIGN PATENT DOCUMENTS

| | | | |
|---|---|---|---|
| 492281 | 7/1992 | European Pat. Off. | 297/146 |
| 1212369 | 3/1960 | France | 297/162 |
| 3903423 | 8/1990 | Germany | 297/162 |

*Primary Examiner*—Peter R. Brown
*Attorney, Agent, or Firm*—Peter D. Keefe

[57] ABSTRACT

A chair with self storable tray is composed of a chair component and a tray component. The chair component is composed of a chair, preferably folding, having a chair seat, chair back, a pair of front legs, a pair of rear legs, and a sheath. The tray component includes a pair of articulated arms, each composed of a first arm segment, a second arm segment and a pivot therebetween. The first and second arm segments are slidably received into a respective sheath. A tray is slidably interconnected with the second arm segments. Located within each of the second arm segments is a support rod which is pivotal from a received position to a support position wherein it is engaged with the chair seat. In operation, a user pulls upon the tray component so that it raises up from behind the chair back, wherein the articulated arms slide outwardly with respect to the sheaths until the pivots thereof are exposed. The user than pivots the second arm segments in relation to the first arm segments so that the tray is located at the front of the chair, while the support rods fall and are seatingly engaged with respect to the chair seat so as to thereby provide support for the tray. The user may slide the tray off the second arm segments to sit upon the chair and then slide it back on.

20 Claims, 7 Drawing Sheets

CHAIR WITH SELF STORABLE TRAY

BACKGROUND OF THE INVENTION

1. Field of the Invention

The present invention relates to chairs and more particularly to chairs with trays. Still more particularly, the present invention relates to a chair having an integrated, self storable tray.

2. Description of the Prior Art

A chair with a tray is extremely useful because it facilitates a seated person to place objects near by, such as for example a meal, paperwork, crossword puzzle, etc. While a separate chair and tray may serve the same purpose, it is far more elegant and efficient if the two can be combined into one cooperating mechanism.

The idea of a chair with an interconnected tray has been known since at least the nineteenth century, such as for example in the form of high chairs for babies, wherein a pivotal tray is integrally connected to the chair (see for example U.S. Pat. Nos. Re. 7,582 and 202,788).

However, what remains needed in the art is a chair with an integral tray in which the tray is self storable when not in use. By "self storable" is meant that the tray is unobtrusively placed with respect to the chair, whereby the impression of an onlooker is that merely a chair is present, not a chair with a tray. Further, what is needed of such a chair with a tray would be ease of movement of the tray from a stored position to a deployed position, and vice versa.

SUMMARY OF THE INVENTION

The present invention is a chair with an integral tray in which the tray is self storable when not in use.

The chair with self storable tray according to the present invention is composed of a chair component and a tray component. The chair component is composed of a chair having a chair seat and chair back, a pair of front legs, a pair of rear legs, and is further composed of a sheath adjacent to, and parallel with, each of the front legs, respectively. In a preferred form of the chair component, the chair thereof is a folding chair, although a non-folding chair may be utilized. The tray component includes a pair of articulated arms, each composed of a first arm segment and a second arm segment which are mutually interconnected by a pivot. The first and second arm segments of each articulated arm is slidably received into a respective sheath. The tray component further includes a tray which slidably interconnects with both second arm segment of the articulated arms. Located within each of the second arm segments is a support rod which is pivotal from a received position to a support position wherein it is engaged with the chair component.

In operation, a user pulls upon the tray component so that it raises up from behind the chair back, wherein the articulated arms slide outwardly with respect to the sheaths until the pivots thereof are exposed. The user than pivots the second arm segments in relation to the first arm segments so that the tray is located at the front of the chair. As the second arm segments arcingly move from an orientation parallel with the chair back to an orientation parallel with the chair seat, the support rods fall to an orientation substantially perpendicular with respect to the chair seat under the action of gravity. The distal end of the support rods are then placed seatingly with respect to the chair component, so as to thereby provide support for the tray. The first arm segments are held with respect to the chair component so that they cannot be accidentally dislodged from the sheaths, such as for example by a user set retainer. The tray component is now in its deployed position. To sit upon the chair, the user slides the tray off the second arm segments, sits down on the chair and then slides the tray again onto the second arm segments. When the user wishes to get up from the chair, he or she need only slide the tray out from the second arm segments.

To return the tray component to its stored position, the user reverses the steps outlined above. It should be noted that when the tray component is in the stored position, the tray is located behind the chair back, very unobtrusively, wherein it is essentially out of sight. When the chair with self storable tray is configured so that the tray component is in the stored position, the chair component will function as a normal chair without any physical or aesthetic hindrance caused by the association of the tray component therewith.

Accordingly, it is an object of the present invention to provide a chair having an integrated tray, wherein the tray is self storing with respect to the chair.

These, and additional objects, advantages, features and benefits of the present invention will become apparent from the following specification.

DETAILED DESCRIPTION OF THE PREFERRED EMBODIMENT

Figure 1:
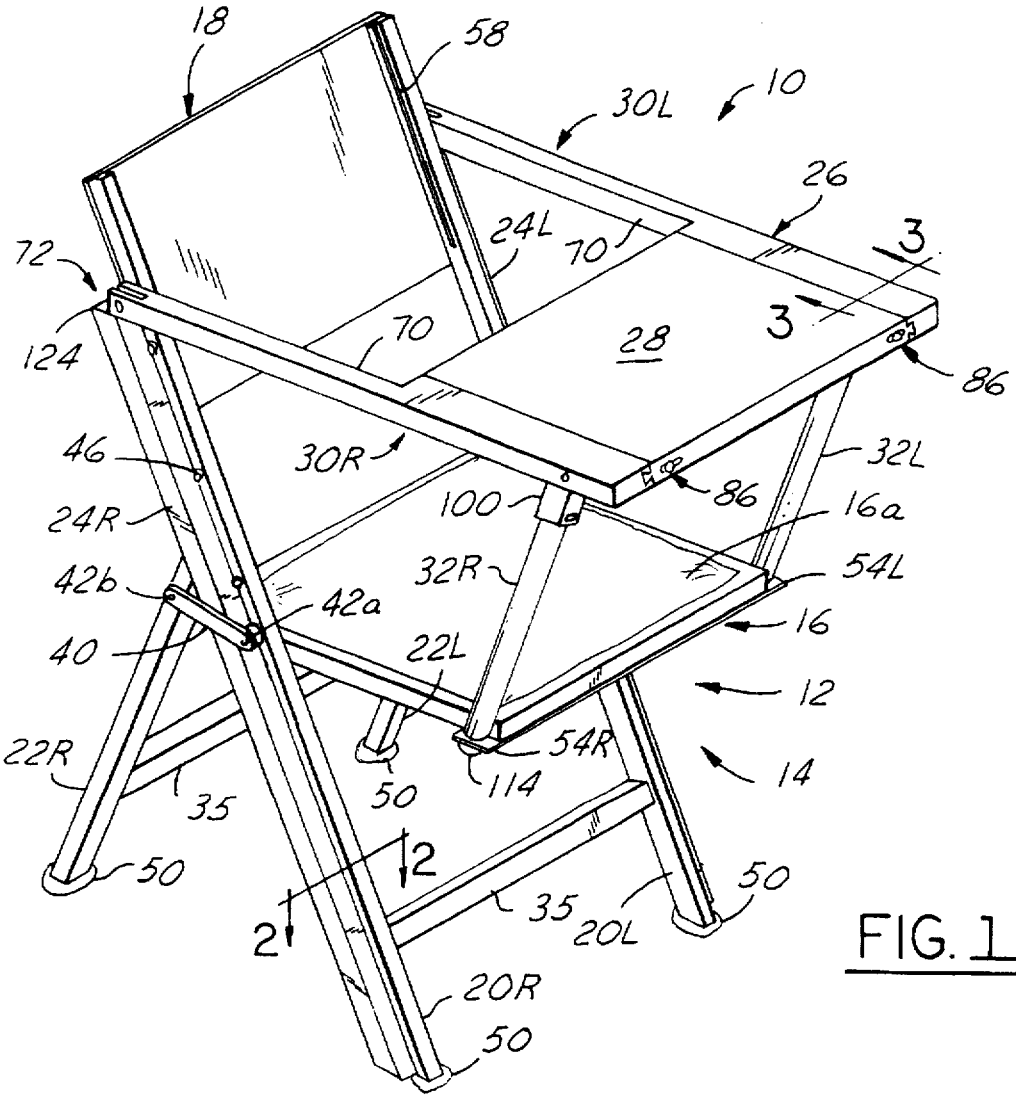
FIG. 1 is a perspective view of a preferred embodiment of the chair with self storing tray according to the present invention.

Referring now to the drawing, FIG. 1 generally depicts the chair with self storable tray 10 according to a preferred embodiment of the present invention. The chair with self storable tray 10 includes a chair component 12 having a chair 14 composed of a chair seat 16, a chair back 18, a right front leg 20R, a left front leg 20L, a right rear leg 22R and a left rear leg 22L. The chair component 12 further has a right sheath 24R which is located adjoining the right front leg 20R and a left sheath 24L which is located adjoining the left front leg 20L. The chair with self storable tray 10 further includes a tray component 26 having a tray 28, a right articulated arm 30R and a left articulated arm 30L, wherein the tray is connected to the right and left articulated arms, and wherein right and left support rods 32R, 32L provide support for the tray in relation to the chair component 12.

Figure 4:
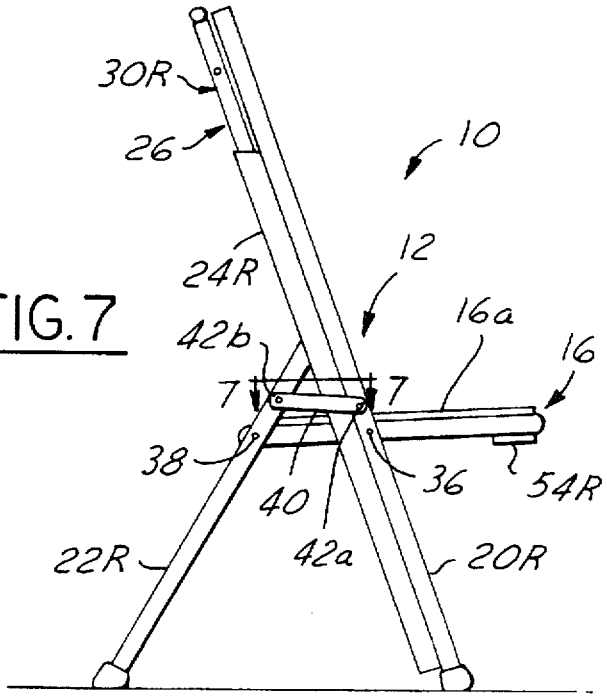
FIG. 4 is a side view of the chair with self storing tray according the present invention, wherein the tray component is shown at the stored position.
Figure 6:
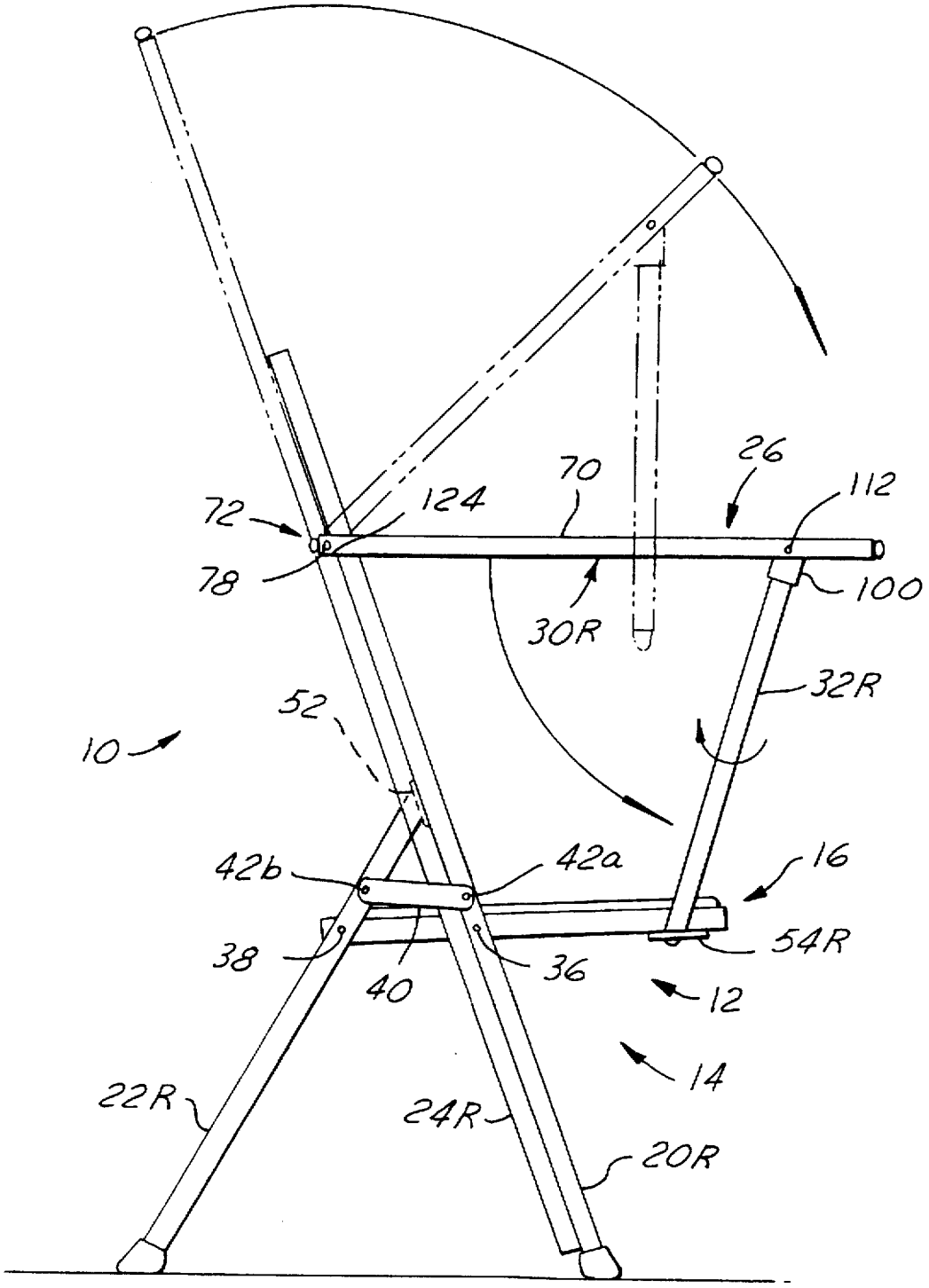
FIG. 6 is a side view of the chair with self storing tray according to the present invention, wherein the tray component is shown at the deployed position.
Figure 8:
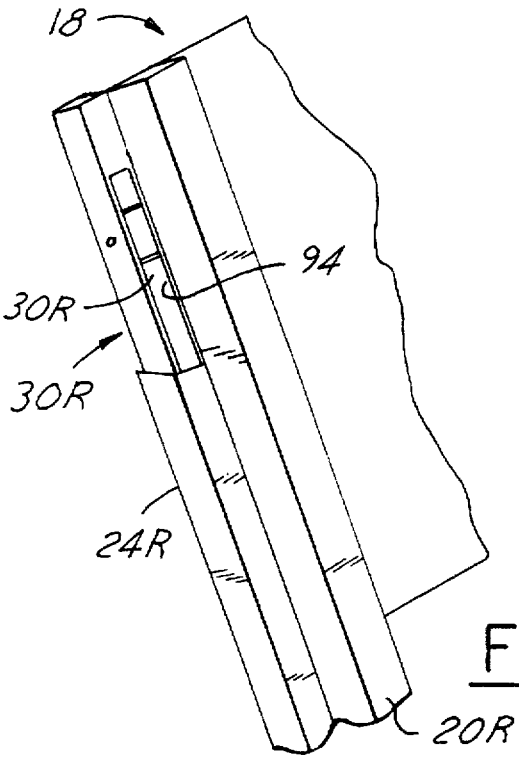
FIG. 8 is a perspective, broken away view of the chair with self storing tray according to the present invention, wherein an articulated arm is shown with the tray component at the stored position.

The chair with self storable tray 10 provides two operative positions for the tray component: a storage position, as shown at FIG. 4, wherein the tray 28 is located unobtrusively behind the chair back 18 with the right and left articulated arms 30R, 30L slidably received inside the right and left sheaths 24R, 24L; and a deployed position, as shown at FIG. 6, wherein the tray is located at the front of the chair substantially parallel with the chair seat 16.

The preferred form of chair 14 of the chair component 12 is a folding chair, however, a non-folding chair may be used as well. Therefore, a folding chair will be detailed herein, although a non-folding chair should be understood to be substitutable therefor. The structural and functional characteristics of the preferred embodiment of the chair with self storable tray 10 will now be detailed with greater particularity.

The Seat Component

The chair seat 16 of the chair 14 is structured for a person to be seated thereupon, and preferably includes a seat pad **16*a*. The chair back 18 of the chair 14 is connected to the right and left front legs 20R, 20L** and is structured for a seated person to place his or her back restably thereagainst.

Figure 7:
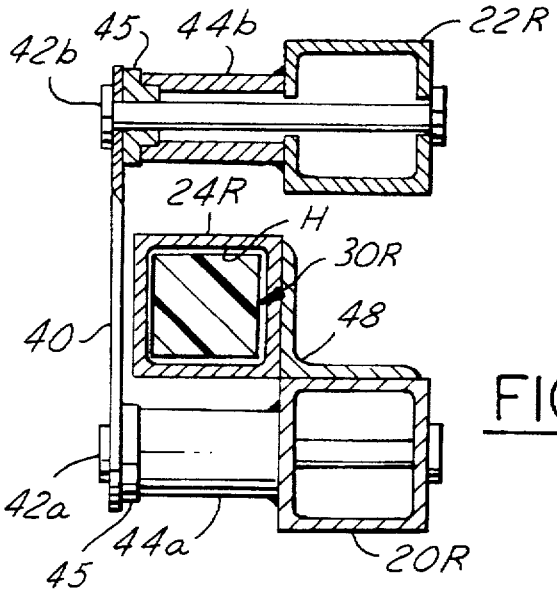
FIG. 7 is a partly sectional view of a preferred folding mechanism of the chair with self storing tray according to the present invention, seen along line 7—7 in FIG. 4.

The chair seat 16 is foldable in relation to the chair back 18 in a manner well known for conventional folding chairs. In this regard, the chair seat is pivotally connected to each of the right and left front legs 20R, 20L via front pivot pins 36; and is pivotally connected to each of the right and left rear legs 22R, 22L via rear pivot pins 38. Further in this regard, straps 40 are pivotally connected via pivot pins **42*a*, 42*b* respectively at each end thereof to respective right and left front legs 20R, 20L and right and left rear legs 22R, 22L. As shown at FIG. 7, the straps 40 are spaced from the respective right or left front and rear legs via spacers 44*a*, 44*b* and optional bushings 45 in order to clear the respective right or left sheath 24R, 24L. The preferred form of pivot pins 36, 38, 42*a*, 42*b*** are rivets.

Figure 2:
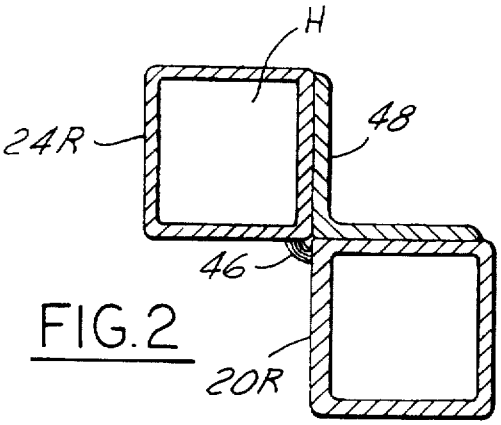
FIG. 2 is a cross-sectional view of a front leg and sheath of the chair with self storing tray according to the present invention, seen along line 2—2 in FIG. 1.

As shown at FIGS. 1, 2 and 7, the right and left sheaths 24R, 24L are respectively connected to right and left front legs 20R, 20L via welding 46 and periodically spaced apart angles 48 which are themselves welded thereto.

The preferred material of construction of the right and left front legs 20R, 20L, the right and left rear legs 22R, 22L and the right and left sheaths 24R, 24L is metallic channel or tubing, such as for example steel or aluminum. Within the right and left sheaths 24R, 24L is an interior hollow H.

Resilient feet 50 are provided at the lower terminal ends of the right and left front legs and right and left rear legs. As shown at FIG. 6, when the chair 14 is at the unfolded configuration, the upper end of the right and left rear legs 22R, 22L abut respective right and left front legs 20R, 20L preferably via a resilient abutment 52.

Connected with the chair seat 16 are right and left rod flanges 54R, 54L for seatably receiving, respectively, a distal end of the support rods 32R, 32L. Cross supports 35 interconnect the right and left front legs 20R, 20L, as well as the right and left rear legs 22R, 22L to provide rigidity to the chair 14. A cross-support 35' is preferably provided between the right and left sheaths 24R, 24L, as well, also for rigidification.

Figure 20:
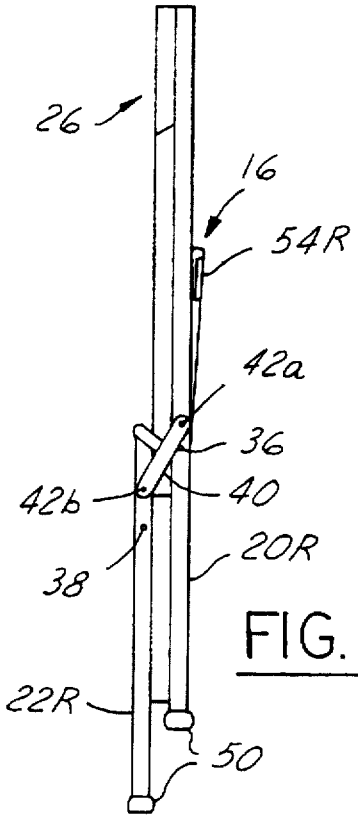
FIG. 20 is a side view of the chair with self storing tray according to the present invention, shown in a folded configuration, wherein the tray component is at the stored position.

In operation of the folding function of the chair 14 starting from the unfolded configuration as shown at FIG. 4, the user grabs both the chair seat 16 and the chair back 18 and then pulls on the chair seat pivotally (upwardly) toward the seat back, as one would normally do with a conventional folding chair. The chair seat 16 then pivots on pivot pins 36, 38 while the straps 40 pivot on pivot pins **42*a*, 42*b* until the chair seat is adjacent the chair back 18, as depicted at FIG. 20. Preferably at the folded configuration, which is shown at FIG. 20, the right and left rod flanges 54R, 54L abut respective right and left front legs 20R, 20L**.

Figure 14:
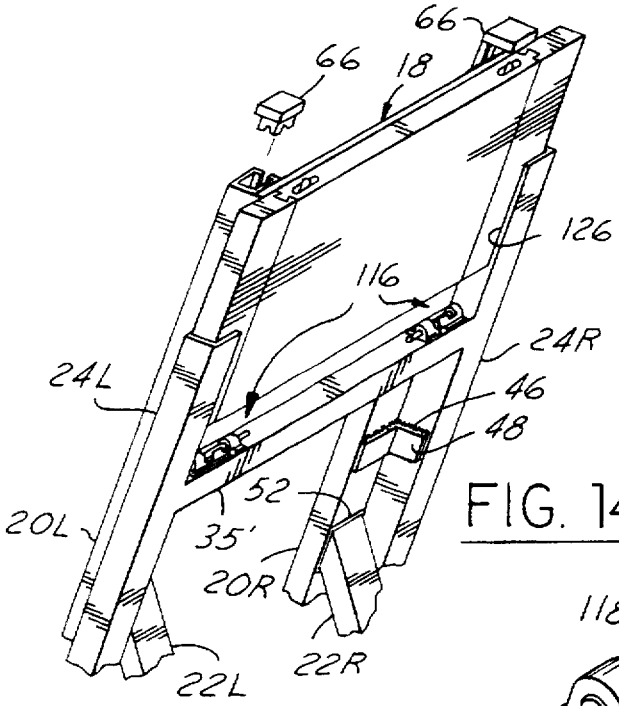
FIG. 14 is a rear perspective view of the chair with self storing tray according to the present invention, wherein the tray component is shown at the stored position.
Figure 16:
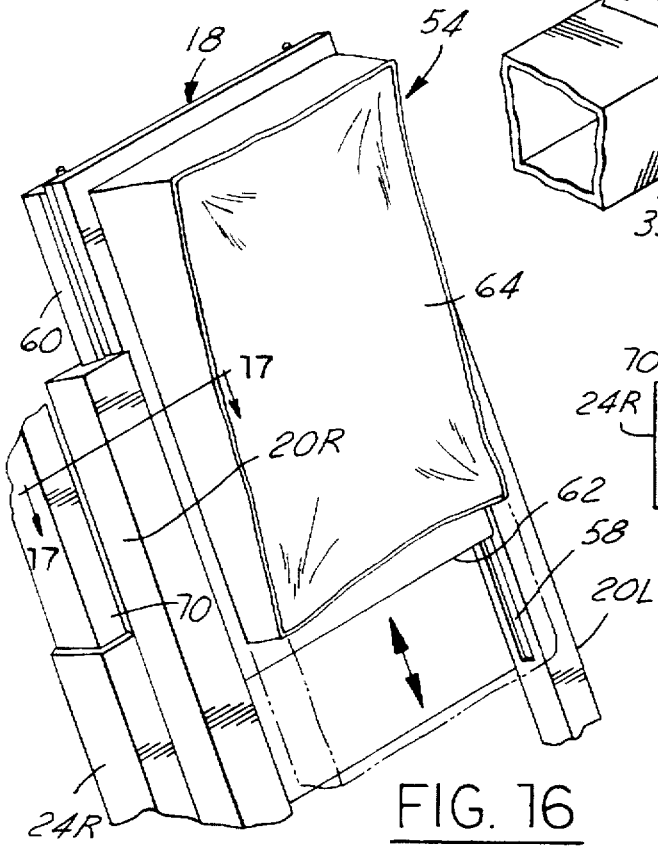
FIG. 16 is a front perspective view of the chair with self storing tray according to the present invention, wherein a preferred form of chair back is depicted including a slidably interfaced cushion.
Figure 17:
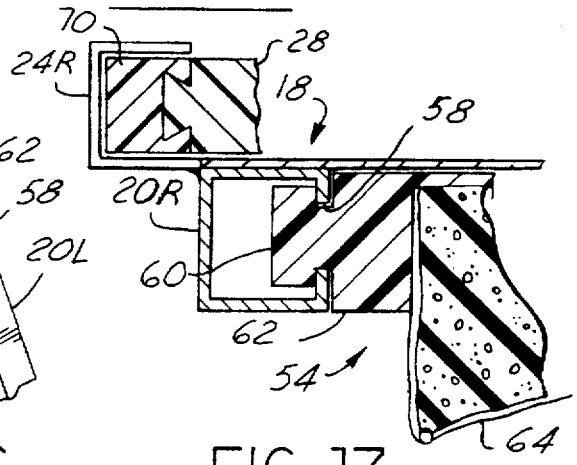
FIG. 17 is a partly sectional view of the sliding interface between the cushion and the chair back and the tray and the chair back, seen along line 17—17 in FIG. 16.

As shown at FIGS. 16 and 17, the chair 14 may include a slidably removable cushion member 56 at the chair back 18. In this regard, an upper end portion of the right and left front legs 20R, 20L at the chair back has a slot 58 into which a T-shaped nib 60 of the backing 62 of the cushion member 56 slides. A padded cushion 64 is attached to the backing 62, and the cushion may be angled in order to provide comfortable support to a seated person's back. As shown at FIG. 14, the upper ends of the right and left front legs 20R, 20L are capped via removable plastic caps 66.

Figure 15:
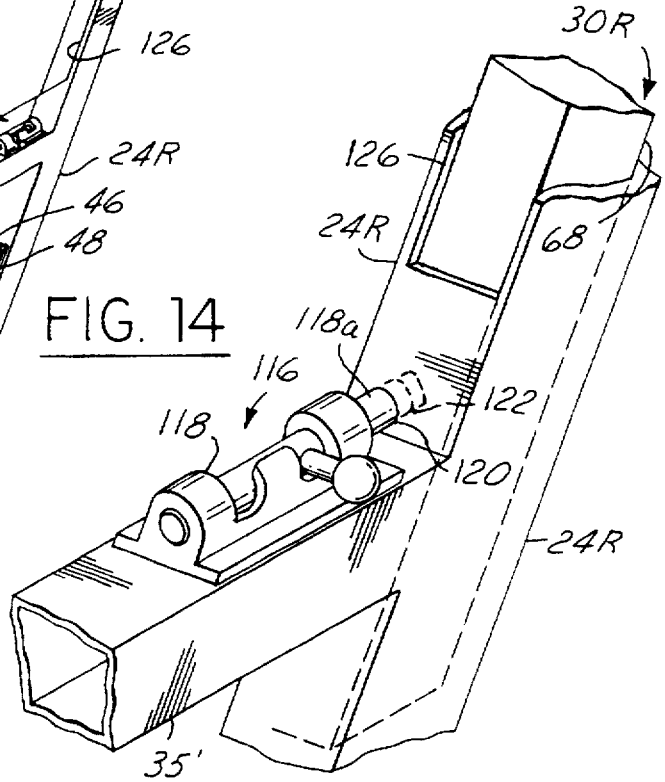
FIG. 15 is a detail perspective view of a lock pin mechanism for the tray component with respect to the chair component.

The right and left sheaths 24R, 24L are oriented substantially parallel to the chair back 18, whereat an upper end portion thereof is provided with slots 126, shown at FIGS. 14 and 15, for receiving therein a portion of the tray component 26, as will become clear hereinbelow.

The Tray Component

Figure 9:
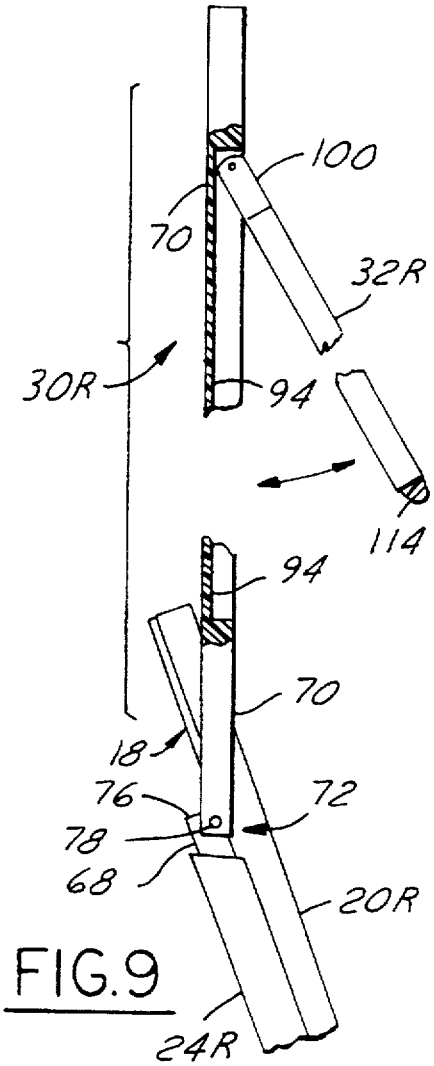
FIG. 9 is a partly sectional side view of the chair with self storing tray according to the present invention, wherein an articulated arm is shown when the second arm segments of the tray component are initially being pivoted toward the deployed position.
Figure 10:
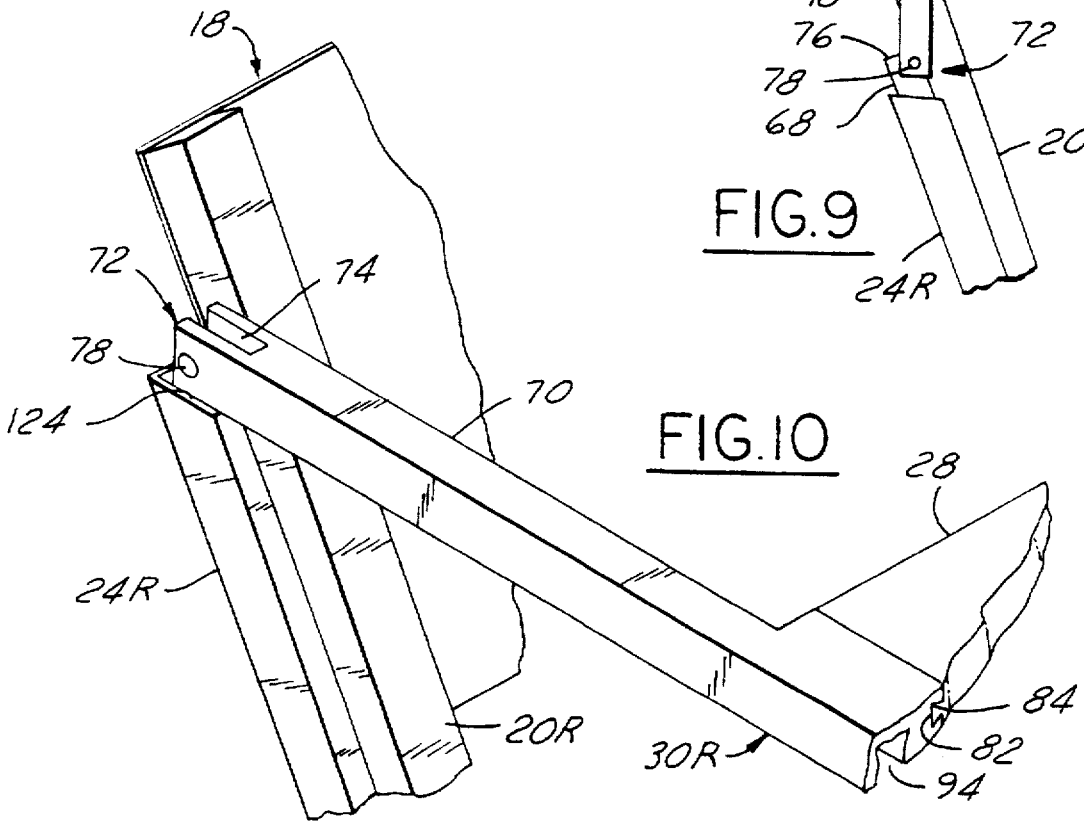
FIG. 10 is a perspective, broken away view of the chair with self storing tray according to the present invention, wherein an articulated arm is shown when the tray component is at the deployed position.

As shown best at FIGS. 9 and 10, the right and left articulated arms 30R, 30L of the tray component 26 each have a first arm segment 68, a second arm segment 70 and a pivot 72 which pivotally interconnects the first and second arm segments. In this regard, the pivots 72 are characterized by a clevis 74 formed in the rear end of the second arm segment 70, a lug 76 which fits into the clevis, and a pivot pin 78 (preferably a rivet) passing collectively therethrough.

The entire first arm segment 68 and at least a major portion of the second arm segment 70 (inclusive of the pivot 72 thereof) are structured in relation to the interior hollow H of the right and left sheaths 24R, 24L so as to be slidably received therein. Accordingly, the articulated right arm is slidably received into the interior hollow H of the right sheath 24R and the left articulated arm 30L is slidably received into the interior hollow H of the left sheath 24L.

Figure 3:
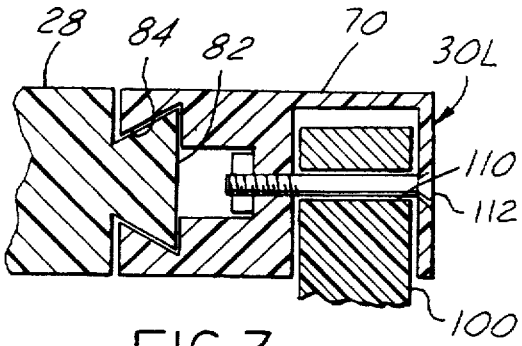
FIG. 3 a partly sectional cross-sectional view of the connection of the tray and a second arm segment of the chair with self storing tray according to the present invention, seen along line 3—3 in FIG. 1.
Figure 13:
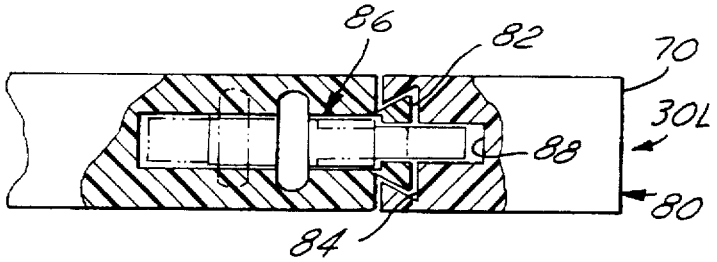
FIG. 13 is a partly section front view of a retainer mechanism for the tray and a second arm segment.

A forward end portion 80 of the second arm segments 70 is slidably connected with the tray 28. In this regard as best shown at FIGS. 3 and 13, the right and left sides 28R, 28L of the tray 28 are provided with a dovetail 82. The dovetail 82 slidably engages a dovetailed slot 84 formed in each of the second arm segments 70. As shown at FIG. 13, a lock pin mechanism 86 carried by the tray 28 adjacent the right and left sides 28R, 28L thereof has a bolt which is user slidable into a bore 88 at the dovetailed slot 84 to thereby selectively hold the tray with respect to the right and left articulated arms 30R, 30L.

Figure 11:
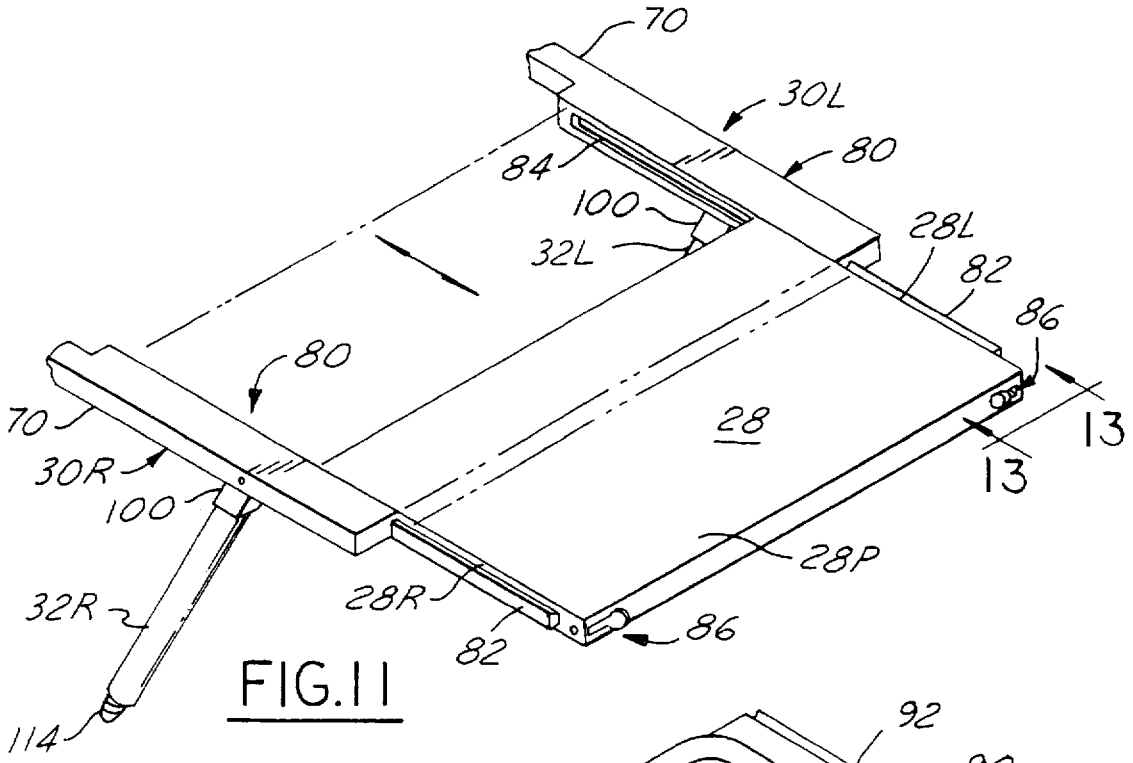
FIG. 11 is a perspective view of the second arm segments and tray of the tray component, wherein the tray is shown being slide with respect to the second arm segments.
Figure 12:
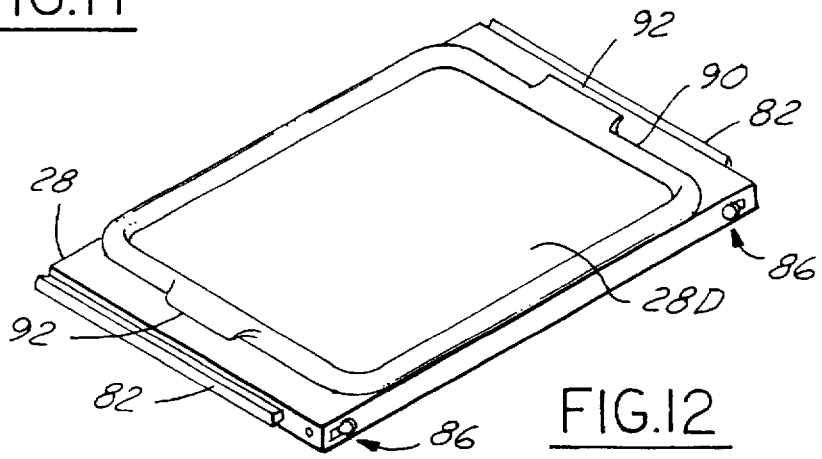
FIG. 12 is a perspective view of a preferred underside structure of the tray.

As comparatively depicted at FIGS. 11 and 12, an upperside 28P of the tray 28 is flat. The upperside 28P is shaped for writing, reading, hobby work, etc. using the tray 28. The underside 28D of the tray 28 has a tray shaped rim 90 for trapping liquid thereinside (such as if a drink was spilled) with handles 92. The underside 28D is shaped for use when eating meals with the tray 28.

The second arm segments 70 are provided with a rod receptacle 94, wherein the support rods 32R, 32L are entirely receivable thereinside. Accordingly, when a right or left support rod is received within its rod receptacle, the second arm segment 70 thereof is able to be received thereat into the interior hollow H of the right or left sheaths 24R, 24L.

Figure 18:
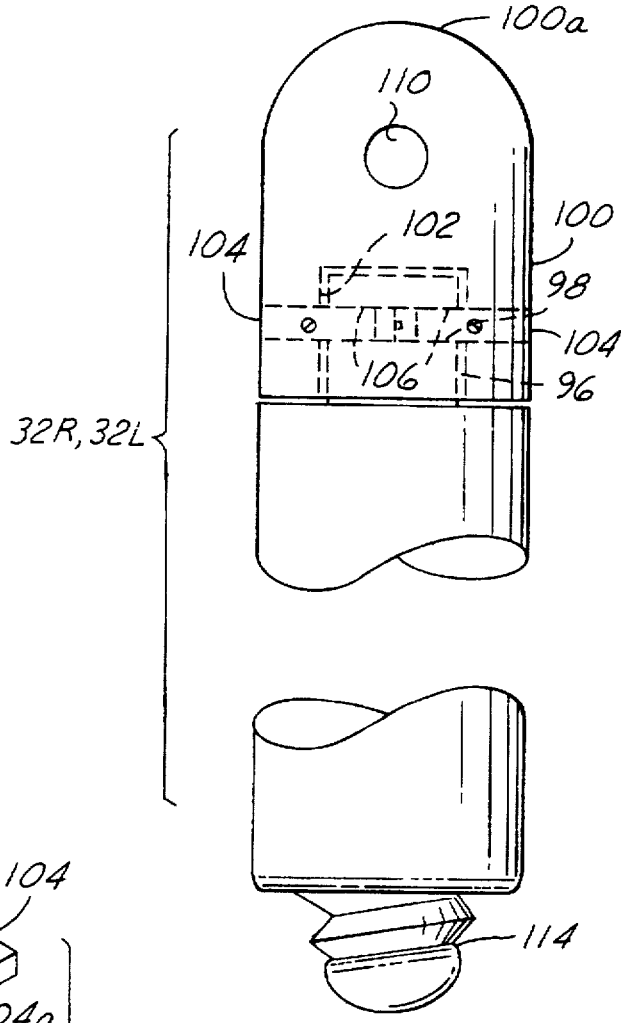
FIG. 18 is a broken away side view of a support rod, showing the near end thereof which pivotally connects with a second arm segment, and showing the distal end thereof which threadably engages a threaded socket of the chair seat.
Figure 19:
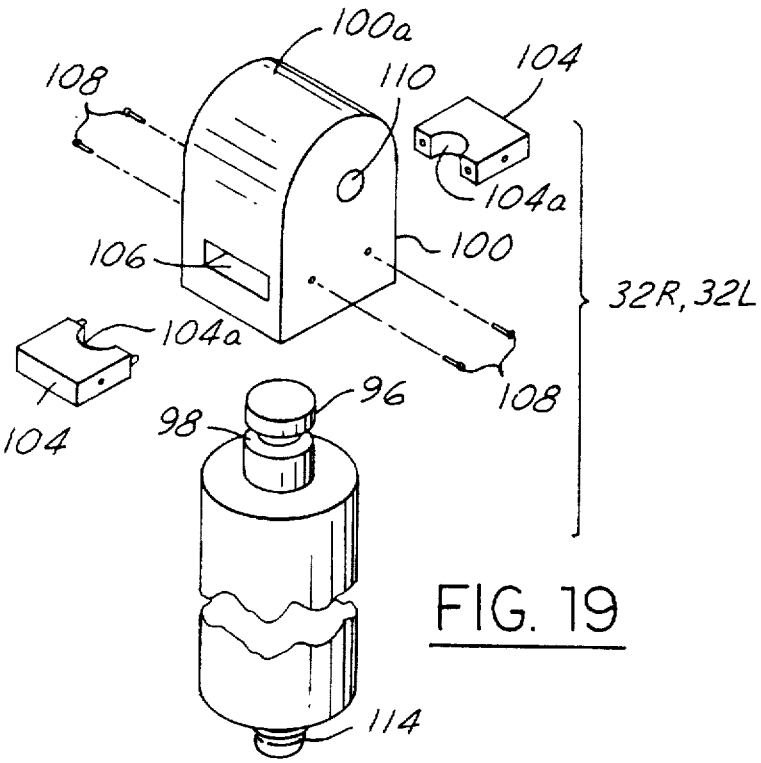
FIG. 19 is an exploded perspective view showing particularly the near end of a support rod.

The near ends of the right and left support rods 32R, 32L are rotatably connected to respective second arm segments 70 at the rod receptacle 94 thereof. As shown at FIGS. 18 and 19, the near end of each of the right and left support rods 32R, 32L includes a rod stud 96 having an annular slot 98 and further includes a rod hub 100. The rod hub 100 has a blind bore 102 which receives the rod stud 96. Keepers 104 slide into lateral slots 106 formed in the rod hub 100 and have a concave front surface **104*a* which interferingly engages the annular slot 98. The keepers 104 are held in place by screws 108. The rod hub 100 has a semicircular upper face 100*a* and a pivot hole 110 radially disposed with respect to the semicircular upper face. As shown best at FIG. 3, a threaded bolt 112 passes through the second arm segment 70 and the pivot hole 110 to thereby pivotally attach the right or left support rod 32R, 32L** respectively thereto via a nut threaded thereon.

In order to provide assured seating of the distal end of the right and left support rods 32R, 32L with respect to the chair seat 16, the right and left rod flanges 54R, 54L are provided with a threaded opening, and the distal end of the right and left support rods are provided with a complimentarily threaded finger 114.

When the right and left articulated arms 30R, 30L are pulled outwardly from the hollow interior H of the respective right and left sheaths 24R, 24L, the first arm segment 68 still has a considerable length thereof located therein even when the pivot 72 is exposed. Still, in order to prevent the first arm segments 68 from dislodging from respective right and left sheaths 24R, 24L, a retainer 116 is provided. As shown at FIG. 15, a preferred retainer 116 is a sliding latch 118 mounted to the cross support 35' which has a bolt **118*a* which is selectively receivable through a hole 120 in the respective right or left sheath 24R, 24L and into a hole 122 in the respective first arm segment 68**.

The preferred material of construction of the right and left articulated arms 30R, 30L, the right and left support rods 32R, 32L and the tray 28 is a structurally strong, impact resistant plastic, although other structural materials may be used, such as for example aluminum.

Operation

Operational details will be recounted beginning with the chair with self storage tray 10 in its folded configuration, as shown at FIG. 20. The user grasps the chair back 18 and the chair seat 16 and thereupon causes the seat to pivot to the unfolded orientation shown in FIG. 4. The chair 14 may now be used as a regular folding chair for seating purposes. When the user decides to again place the chair into the folded configuration, the user again grasps the chair seat and chair back and causes the chair seat to pivot to the chair back, as depicted at FIG. 20.

Figure 5:
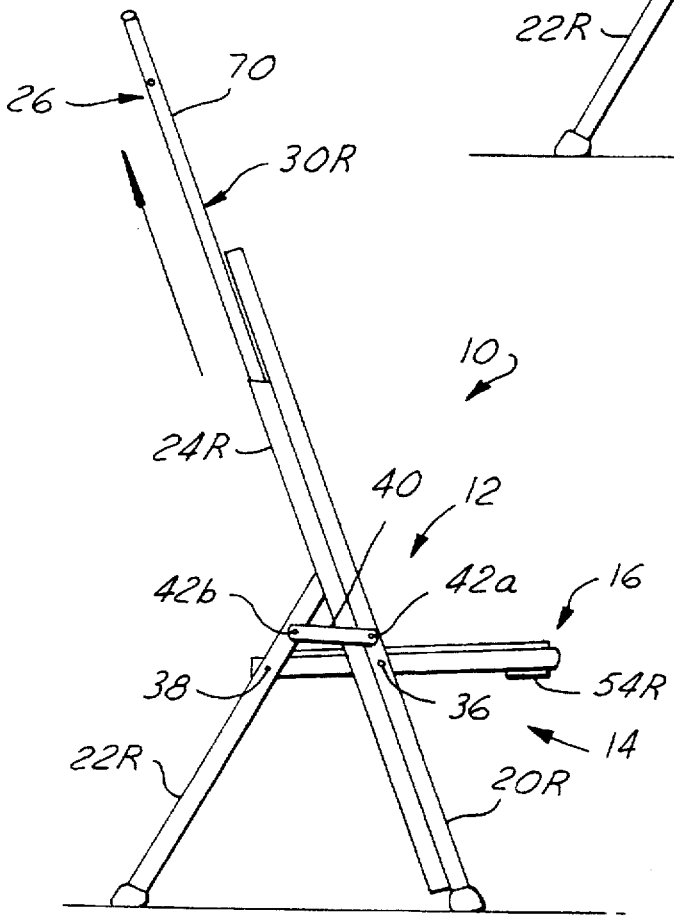
FIG. 5 is a side view of the chair with self storing tray according to the present invention, wherein the tray component is shown in an intermediate position between the stored and deployed positions.

Should the user wish to use the tray component 26 the following procedure is used. With the chair in the unfolded configuration of FIG. 4, the user grasps the tray 28 and pulls upon the tray component, whereupon the right and left articulated arms 30R, 30L slide outwardly in relation to the right and left sheaths 24R, 24L, as shown at FIG. 5. When the pivots 72 become exposed, the user then rotates the second arm segments 70 so that the tray 28 becomes substantially parallel to the chair seat, as shown at FIG. 6. As the second arm segments are pivoted, the support rods 32R, 32L fall to an orientation substantially perpendicular with respect to the chair seat by the action of gravity. The threaded fingers 114 of the right and left support rods 32R, 32L are then rotated with respect to the chair component (enabled by the rod hub 100) and thereby threadably engaged with the threaded opening at the right and left rod flanges 54R, 54L. It should be noted in this regard, that it is preferred for the upper end 124 of the right and left sheaths to be angled so as to be parallel with the orientation of the second arm segment when in the deployed position, whereby it restably abuts the second arm segments at this position (see for example FIG. 6). Now the tray 28 is supported by the upper ends 124 of the right and left sheaths and the right and left support rods. The user then actuates the retainer 16 to lock the first arm segments 68 at this position. The tray component is now in its deployed position.

To sit upon the chair, the user releases the lock pin mechanisms 86 and then slides the tray off the second arm segments, sits down on the chair, slides the tray again onto the second arm segments, and then engages the lock pin mechanisms. When the user wishes to get up from the chair, he or she need only slide the tray out from the second arm segments. To return the tray component to its stored position, the user reverses the steps outlined above.

When the tray component is in the stored position, the tray is located behind the chair back via slidable passage into the slot 126 at the upper end portion of the right and left sheaths 24R, 24L (see FIGS. 14 and 15), very unobtrusively, wherein it is essentially out of sight. When the chair with self storable tray is configured so that the tray component is in the stored position, the chair component will function as a normal chair without any physical or aesthetic hindrance caused by the association of the tray component therewith.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A chair with self storing tray comprising:

a chair component comprising:

a chair; and sheath means connected with said chair for providing an interior hollow; and a tray component comprising:

a tray; and articulated arm means for supporting said tray with respect to said chair component; wherein said articulated arm means is slidably receivable with respect to said interior hollow of said sheath means;

wherein said tray is placed into a stored position behind said chair by slidably receiving said articulated arm means into said sheath means, and wherein said tray is placed into a deployed position in front of said chair by selectively sliding said articulated arm means outwardly from said sheath means and articulating sailed articulated arm means.

2. The chair with self storing tray of claim 1, wherein said articulated arm means comprises:

a right articulated arm comprising:

a first right arm segment;

a second right arm segment; and right pivot means for pivotally connecting said first and second right arm segments; and a left arm segment comprising:

a first left arm segment;

a second left arm segment; and left pivot means for pivotally connecting said first and second left arm segments;

wherein said tray is connected to said second right and left arm segments.

3. The chair with self storing tray of claim 2, further comprising selective release means f or removably connecting said tray to said second right and left arm segments.

4. The chair with self storing tray of claim 3, wherein said sheath means comprises:

a right sheath having a first portion of said interior hollow into which said right articulated arm is slidably receivable; and a left sheath having said second portion of said interior hollow into which said left articulated arm is slidably receivable.

5. The chair with self storing tray of claim 4, wherein said chair comprises:

a chair seat;

a chair back connected with said chair seat;

a right front leg connected to at least one of said chair seat and said chair back;

a left front leg connected to at least one of said chair seat and said chair back;

a right rear leg connected to at least one of said chair seat and said chair back; and a left rear leg connected to at least one of said chair seat and said chair back.

6. The chair with self storing tray of claim 5, wherein said right and left sheaths are oriented substantially parallel with respect to said seat back.

7. The chair with self storing tray of claim 6, further comprising tray support means connected with said articulated arm means for supporting said tray with respect to said chair component when in the deployed position.

8. The chair with self storing tray of claim 7, wherein said tray support means comprises:

a right support rod;

right second arm segment receptacle means formed in said right second arm segment for receiving therein said right support rod;

means for pivotally connecting said right support rod to said right second arm segment receptacle means;

means for enabling rotation of at least a portion of said right support rod with respect to said right arm segment receptacle means;

right flange means connected with said chair for supportably receiving said right support rod;

a left support rod;

left second arm segment receptacle means formed in said left second arm segment for receiving therein said left support rod;

means for pivotally connecting said left support rod to said left second arm segment receptacle means;

means for enabling rotation of at least a portion of said left support rod with respect to said left arm segment receptacle means; and left flange means connected with said chair for supportably receiving said left support rod wherein when said tray is at the deployed position said right second arm segment abuts in supportive relation to said right sheath and wherein said left second arm segment abuts in supportive relation to said left sheath.

9. The chair with self storing tray of claim 8, wherein said right support rod is threadably engageable with respect to said right flange means; and wherein said left support rod is threadably engageable with respect to said left flange means.

10. The chair with self storing tray of claim 9, wherein said chair is a folding chair, wherein said chair further comprises pivot means connected to said right and left front legs, said right and left rear legs and said chair seat for pivotably connecting said chair seat with respect to said chair back.

11. The chair with self storing tray of claim 9, wherein said tray has an upper side and an opposite underside; said upperside having a flat surface, said underside having rim means for retaining liquids within a predetermined area of said underside, said rim means having handle means f or a user to graspingly carry said tray.

12. The chair with self storing tray of claim 9, further comprising retainer means for preventing said right first arm segment from outwardly sliding from said right sheath beyond a predetermined length, and for preventing said left first arm segment from outwardly sliding from said left sheath beyond said predetermined length.

13. The chair with self storing tray of claim 9, wherein when said tray is at the stored position said tray is located substantially immediately behind said seat back.

14. The chair with self storing tray of claim 9, wherein said right sheath is connected to and oriented parallel with said right front leg, and said left sheath is connected to and oriented parallel with said left front leg.

15. A chair with self storing tray comprising:

a chair component comprising:

a chair; and sheath means connected with said chair for providing an interior hollow; and a tray component comprising:

a tray;

articulated arm means for supporting said tray with respect to said chair component, wherein said articulated arm means is slidably receivable with respect to said interior hollow of said sheath means, said articulated arm means comprising:

a right articulated arm comprising a first right arm segment; a second right arm segment; and right pivot means for pivotally connecting said first and second right arm segments; and a left arm segment comprising a first left arm segment; a second left arm segment; and left pivot means for pivotally connecting said first and second left arm segments;

wherein said tray is connected to said second right and left arm segments;

selective release means for removably connecting said tray to said second right and left arm segments; and tray support means connected with said articulated arm means for supporting said tray with respect to said chair component when in the deployed position;

wherein said tray is placed into a stored position behind said chair by slidably receiving said articulated arm means into said sheath means, and wherein said tray is placed into a deployed position in front of said chair by selectively sliding said articulated arm means outwardly from said sheath means and articulating said articulated arm means.

16. The chair with self storing tray of claim 15, wherein said tray support means comprises:

a right support rod;

right second arm segment receptacle means formed in said right second arm segment for receiving therein said right support rod;

means for pivotally connecting said right support rod to said right second arm segment receptacle means;

means for enabling rotation of at least a portion of said right support rod with respect to said right arm segment receptacle means;

right flange means connected with said chair for supportably receiving said right support rod;

a left support rod;

left second arm segment receptacle means formed in said left second arm segment for receiving therein said left support rod;

means for pivotally connecting said left support rod to said left second arm segment receptacle means;

means for enabling rotation of at least a portion of said left support rod with respect to said left arm segment receptacle means; and left flange means connected with said chair for supportably receiving said left support rod;

wherein when said tray is at the deployed position said right second arm segment abuts in supportive relation to said right sheath and wherein said left second arm segment abuts in supportive relation to said left sheath.

17. The chair with self storing tray of claim 16, wherein said sheath means comprises:

a right sheath having a first portion of said interior hollow into which said right articulated arm is slidably receivable; and a left sheath having said second portion of said interior hollow into which said left articulated arm is slidably receivable;

wherein said right and left sheaths are oriented substantially parallel with respect to said seat back.

18. The chair with self storing tray of claim 17, wherein said right support rod is threadably engageable with respect to said right flange means; and wherein said left support rod is threadably engageable with respect to said left flange means.

19. The chair with self storing tray of claim 18, further comprising retainer means for preventing said right first arm segment from outwardly sliding from said right sheath beyond a predetermined length, and for preventing said left first arm segment from outwardly sliding from said left sheath beyond said predetermined length.

20. A folding chair with self storing tray comprising:

a chair component comprising:

a folding chair having a chair seat, a chair back leg means for supporting the chair, and pivot means for pivotably connecting said chair seat with respect to said chair back; and sheath means connected with said chair for providing an interior hollow; and a tray component comprising:

a tray;

articulated arm means for supporting said tray with respect to said chair component, wherein said articulated arm means is slidably receivable with respect to said interior hollow of said sheath means, said articulated arm means comprising:

a right articulated arm comprising a first right arm segment; a second right arm segment; and right pivot means for pivotally connecting said first and second right arm segments;

a left arm segment comprising a first left arm segment; a second left arm segment; and left pivot means for pivotally connecting said first and second left arm segments;

wherein said tray is connected to said second right and left arm segments; and selective release means for removably connecting said tray to said second right and left arm segments;

tray support means connected with said articulated arm means for supporting said tray with respect to said chair component when in the deployed position;

wherein said tray is placed into a stored position behind said chair by slidably receiving said articulated arm means into said sheath means, and wherein said tray is placed into a deployed position in front of said chair by selectively sliding said articulated arm means outwardly from said sheath means and articulating said articulated arm means.

* * * * *